United States Patent [19]

Tsuruta et al.

[11] 4,241,646

[45] Dec. 30, 1980

[54] PAINTING BOOTH ON CONVEYOR LINE

[75] Inventors: Mitsuo Tsuruta, Tokyo; Hachiro Haga, Zushi, both of Japan

[73] Assignee: Nissan Motor Company, Limited, Yokohama, Japan

[21] Appl. No.: 947,639

[22] Filed: Oct. 2, 1978

[30] Foreign Application Priority Data

Nov. 10, 1977 [JP] Japan ..... 52/134091

[51] Int. Cl.[3] ..... B05C 15/00

[52] U.S. Cl. ..... 98/115 SB; 118/326; 118/DIG. 7

[58] Field of Search ..... 98/115 R, 115 SB, 36; 118/58, 64, 326, 634, DIG. 7; 34/227, 231, 233

[56] References Cited

U.S. PATENT DOCUMENTS

| | | | |
|---|---|---|---|
| 2,140,337 | 12/1938 | Somes | 34/233 X |
| 2,155,932 | 4/1939 | Davis | 118/326 |
| 2,661,310 | 12/1953 | Page et al. | 118/58 X |
| 3,138,087 | 6/1964 | Larsson et al. | 98/115 SB |
| 3,370,404 | 2/1968 | Leeper | 98/115 SB X |
| 3,807,291 | 4/1974 | Roberts et al. | 98/115 SB |
| 4,096,300 | 6/1978 | William et al. | 118/326 X |

FOREIGN PATENT DOCUMENTS

| | | | |
|---|---|---|---|
| 545271 | 6/1956 | Italy | 118/58 |
| 748774 | 5/1956 | United Kingdom . | |
| 812755 | 4/1959 | United Kingdom . | |

*Primary Examiner*—Albert J. Makay
*Assistant Examiner*—Harold Joyce
*Attorney, Agent, or Firm*—Schwartz, Jeffery, Schwaab, Mack, Blumenthal & Koch

[57] ABSTRACT

A painting booth through which a conveyor passes to transfer articles such as automobile bodies to be painted. The booth comprises spraying spaces each with a paint spraying machine disposed therein, buffer spaces adjoining the respective spraying spaces and a duct arranged to blow air into each spraying space. To minimize power and heat expenses for operation of the booth, each buffer space has a cross-sectional area smaller than the cross-sectional area of each spraying space. The buffer spaces may be provided with no forcible ventilation. Alternatively, the booth may comprise another duct to blow air into at least one of the buffer spaces through air inlets arranged such that air flows in the buffer space towards an adjoining spraying space at a velocity lower than the velocity of a flow of air in the spraying space.

8 Claims, 6 Drawing Figures

PAINTING BOOTH ON CONVEYOR LINE

BACKGROUND OF THE INVENTION

This invention relates to a painting booth constructed on a conveyor line for continuous production of, for example, automobiles.

Automobile bodies with be taken as a typical example of articles to be painted in painting booths described in this specification although a painting booth accordng to the invention is of use also in mass production of various other articles such as household electric appliances.

On current automobile assembly lines, coating of automobile bodies with paint is performed usually in a tunnel-like enclosure, called a painting booth, through which passes a conveyor to carry the bodies. Such a painting booth is several times as long as the length of an automobile body and gives therein one spraying room which occupies an almost entire volume of the interior of the booth, so that several workers can move in this spraying room along the bodies carried on the conveyor to perform painting operation with hand spray guns at any section of the spraying room. A ventilation duct extends along the booth, usually on the ceiling of the spraying room, to blow a temperature and humidity controlled air into the spraying room. Due to the manner of painting operation in the spraying room, the arrangement of the ventilation duct and the capacity of the air conditioner are made such that air flows through every section of the spraying room at a nearly uniform rate, meaning that a uniform atmosphere is maintained throughout the spraying room. The air flows out of the spraying room together with paint dust through a grated floor of the booth and enters a washing zone which is defined between the floor and a water pit constructed below the booth. On the outside of the spraying room, ventilation ducts extend from the washing zone to discharge washed air into the atmosphere.

It is a recent trend to replace hand spray guns used in the above described painting booth with an automated spraying machine, or machines, which sprays a large quantity of paint within a limited region of the booth or the aforementioned spraying room. When such a spraying machine is introduced into a painting booth of the described type, the need of supplying air uniformly into a wide spraying room constitutes a disadvantage of the booth. Since the rate of air supply must be increased in compliance with an increased rate of paint spraying by the spraying machine, there occurs a considerable increase in the quantity of air per unit time to be supplied to the painting booth. Accordingly there arises the need of augmenting the capacity of the air conditioner including a blower, and as a result there occurs considerable increase in power and heat expenses for operation of the painting booth.

SUMMARY OF THE INVENTION

It is an object of the present invention to provide an improved painting booth constructed on a conveyor line for transfer of articles to be painted, which painting booth is suitable for a continuous coating operation with at least one automated spraying machine from both functional and economical viewpoints.

It is another object of the invention to provide an improved painting booth of the described type, which booth is particularly suitable for use in the production of automobiles and can maintain therein an atmosphere suitable for the operation of an automated spraying machine with reduced expenses for conditioning air to be supplied to the booth.

A painting booth according to the invention, through which a conveyor passes to transfer articles to be painted, comprises at least one spraying space with a spraying machine installed therein and at least one buffer space adjoining each spraying space. The spraying and buffer spaces are arranged alternately with each other in the direction of the conveyor. Each spraying space is provided with an air blowing duct and air inlets arranged such that a flow of air is established in a direction generally normal to the direction of the conveyor substantially in every region of the spraying space. As the essential feature of this painting booth, the cross-sectional area of each buffer space is made smaller than the cross-sectional area of each spraying space.

In a first embodiment of the invention, each buffer space is provided with no air blowing means so that substantially no flow of air is established therein.

In a second embodiment of the invention, at least one buffer space is provided with an air blowing duct and air inlets arranged such that a flow of air is established therein in a direction generally parallel to the direction of the conveyor and that the velocity of the air flow in this buffer space is lower than the velocity of the air flow in an adjoining spraying space. In this case, the air blowing duct for this buffer space may be connected to the air blowing duct for an adjoining spraying space so that air may be blown into the spraying and buffer spaces substantially at the same temperature and substantially with the same humidity. Alternatively, the air blowing ducts for the spraying and buffer spaces may be made independent from each other so that air may be blown into the spraying and buffer spaces at different temperatures and with different humidities.

DESCRIPTION OF THE PREFERRED EMBODIMENTS

Figure 1:
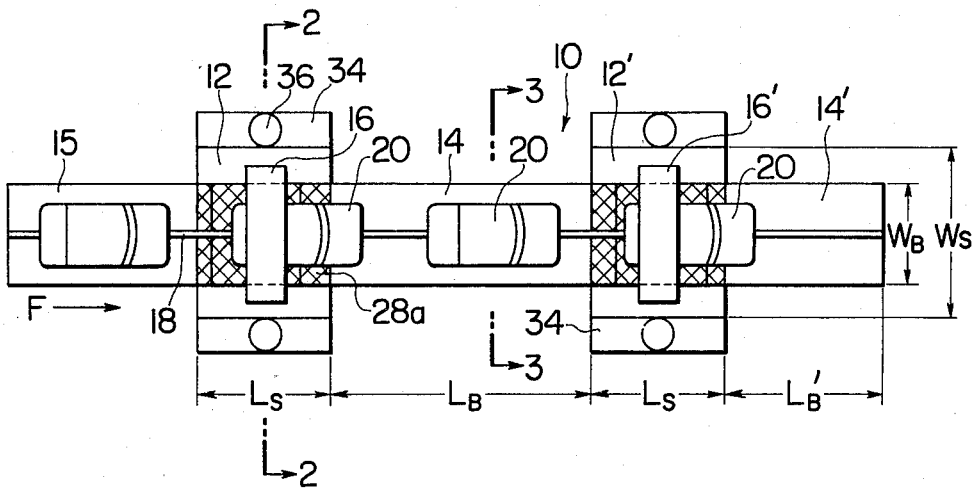
FIG. 1 is a horizontal sectional view of a painting booth constructed on an automobile assembly line as an embodiment of the invention.
Figure 2:
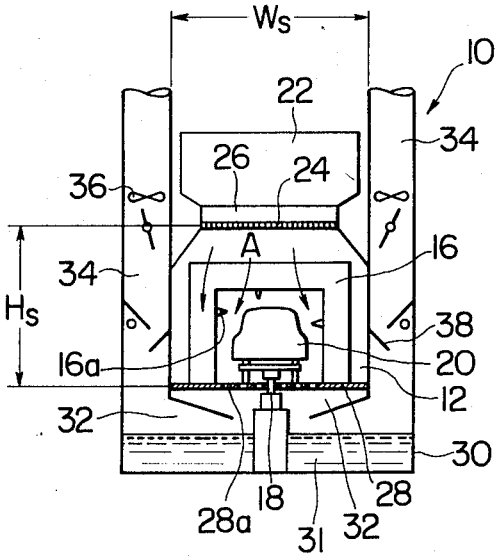
FIG. 2 is a vertical sectional view of the painting booth of FIG. 1 in a spraying zone thereof.
Figure 3:
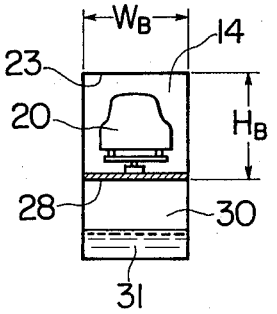
FIG. 3 is a vertical sectional view of the same booth in a buffer zone thereof.

FIGS. 1–3 show a painting booth 10 according to the invention, which occupies a section of an automobile assembly line. Automobile bodies 20 to be painted are carried on a conveyor 18 passing through this booth 10 from the left to the right in FIG. 1 as indicated by the arrow F. In this example the painting booth 10 comprises two spaces designated as spraying zones 12 and 12' at a distance therebetween in the direction of the conveyor 18. A space designated as buffer zone 14 adjoins both of the two spraying zones 12 and 12' so as to occupy an entire length (indicated by $L_B$) of the distance between the two spraying zones 12 and 12', and another buffer space or zone 14' conjoinedly follows the spraying zone 12' on the downstream side. There is no partition between each spraying zone 12(12') and the adjoining buffer zones 14, 14'. In each spraying zone 12(12'), there is an automated spraying machine 16(16') which may be of a gantry type reciprocable along the conveyor 18 and has a plurality of spraying guns 16*a*. Of course each of the spraying machines 16,16' may be replaced by spraying robots. In any case each spraying machine 16(16') is provided with a sensor (not shown), which detects the arrival of each automobile body 20 at a prescribed position, and initiates its action in response to a signal from the sensor.

A ventilation duct 22 which extends from an external air conditioner including a blower (not shown) is arranged to constitute the ceiling of each spraying zone 12(12') with the provision of a deflector 26 to blow air regulated, for example, to 20° C. and 85% relative humidity downwards into the spraying zone 12(12') through an air filter 24. The painting booth 10 has a horizontal floor 28 and is constructed above a pit 30 which is provided with a water pipe (not shown) and serves as a sink. In a transversely central region of each spraying zone 12(12') the floor 28 takes the form of a grating 28*a*, so that the air blown into the spraying zone 12(12') flows through this zone generally vertically (as indicated by the arrows A in FIG. 2) and, together with a dust of the sprayed paint, enters a space 32 between the floor 28 and water 31 in the pit 30. Beneath each spraying zone 12(12'), this space 32 (and the water 31 in the pit 30) serves as a washing zone where a considerable portion of the paint dust suspended in the air flown out of the spraying zone 12(12') transfers into the water 31 during passage of the air through this space 32. On the outside of each spraying zone 12(12') ventilation ducts 34 extend from the washing zone 32 to let out the washed air into the atmosphere. The ducts 34 are provided with ventilation fans 36 and certain means such as baffle plates 38 for removal of the remaining portion of the paint dust from the air.

The buffer zones 14 and 14' are provided with neither painting machines nor ventilation ducts. Each of these zones 14,14' has an ordinary ceiling 23, and the floor 28 in these zones 14, 14' is not grated or apertured. Thus, each buffer zone 14(14') is no more than a tunnel-like enclosure.

The inside dimensions of the spraying zone 12, length $L_S$, width $W_S$ and height $H_S$, are determined based on the quantity of paint sprayed from the machine 16(16') per unit time and the surface area of the automobile body 20 to be painted. In the illustrated case the second spraying zone 12' has the same dimensions as the first spraying zone 12, but a difference, or differences, in length, width and/or height may exist between two spraying zones 12 and 12'. The length $L_B$ of the buffer zone 14 between the two spraying zones 12, 12' is determined so as to prevent mixing or contact of a paint spray from the painting machine 16 with a paint spray from the other machine 16' and to make it possible to effect painting in the second spraying zone 12' on a paint coating provided on each autombile body 20 in the first spraying zone 12. The inside width $W_B$ and height $H_B$ of the buffer zone 14 are determined, with due consideration of an atmosphere desirable for setting or drying of the paint coating provided in the first spraying zone 12, such that the vertical cross-sectional area ($W_B \times H_B$) of the buffer zone 14 is smaller than the vertical cross-sectional area ($W_S \times H_S$) of each spraying zone 12(12'). It is preferable that the buffer zone 14 is smaller than the spraying zones 12, 12' both in width and height.

The buffer zone 14' on the downstream side is identical in construction with the former buffer zone 14, and the vertical cross-sectional area (width by height) of this buffer zone 14' is made smaller than that of the adjacent spraying zone 12'. However, the length $L_B'$ of this buffer zone 14' may differ from the length $L_B$ of the buffer zone 14 since this buffer zone 14' is not followed by any spraying zone but conjoins a setting or drying room which precedes a tunnel oven.

A space or zone 15 conjoinedly preceding the first spraying zone 12 serves as an approach from a station preparatory to the painting operation to the spraying zone 12. This zone 15 is identical in construction with the buffer zone 14 and is smaller in vertical cross-sectional area than the spraying zone 12. Accordingly this zone 15, too, can be regarded as a buffer zone.

Due to the described differences in construction and dimensions between the spraying zones 12, 12' and the buffer zones 14, 14' and 15, the air (A) generally vertically passing through the spraying zones 12, 12' hardly intrudes into the buffer zones 14, 14', 15 although there is no shutter at the entrance and exit of each spraying zone.

Figure 4:
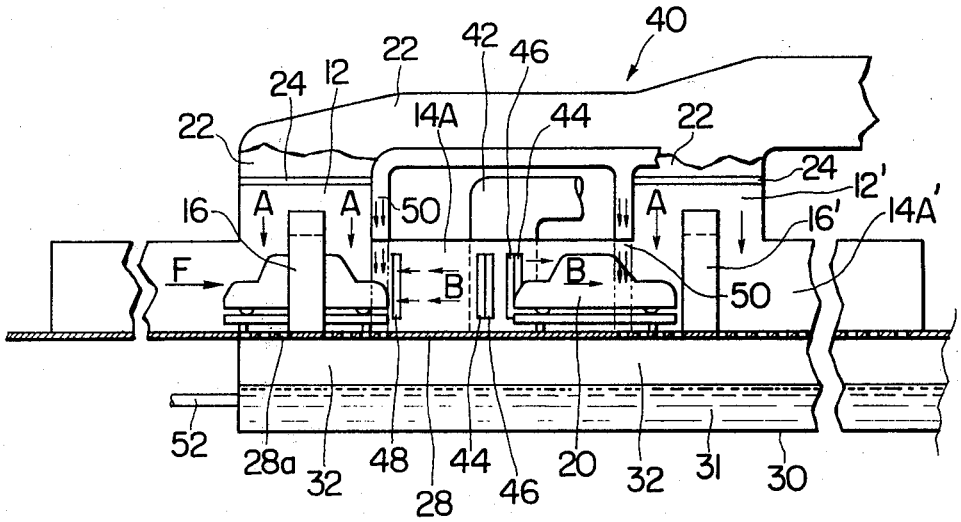
FIG. 4 is a longitudinal sectional view of a painting booth which is a modification of the booth of FIGS. 1–3.

A painting booth 40 shown in FIG. 4 is another embodiment of the invention. This booth 40 is fundamentally similar to the booth 10 of FIGS. 1-3, but a buffer zone 14A between two spraying zones 12 and 12' in this booth 40 differs from the corresponding buffer zone 14 of FIG. 1 in that air is blown into this zone 14A from a ventilation duct 42. This modification is made with the purpose of promoting drying of a paint coating on each automobile body 20 travelling from the first spraying zone 12 to the second spraying zone 12'. In cases where use is made of a water paint or a paint of an organic solvent type in the first spraying zone 12, a rapid drying of a resultant paint coating on each body 20 is desirable both to prevent flowing or dripping of the paint applied to each automobile body and to allow the application of another paint onto the painted body 20 in the second spraying zone 12'.

The ventilation duct 42 extends from an external air conditioner including a blower (not shown) and opens into the buffer zone 14A at air inlets 44 formed in, or provided on, the side walls of the booth 40 in this zone 14A. Each air inlet 44 is provided with a deflector 46 such that the air blown into the buffer zone 14A flows generally horizontally towards a conjoined spraying zone 12 or 12' (as indicated by the arrows B in FIG. 4) at velocities lower than the velocities of the flow A of air in each spraying zone 12(12'). The air (B) thus flowing in the buffer zone 14A promotes evaporation of water or organic solvent contained in the paint applied to the body 20. This air enters the spraying zone 12(12') together with the evaporated water or organic solvent but, because of a relatively low flow velocity thereof, does not significantly influence the flow A of air or interfere with the painting operation in the spraying zone 12(12'). As a consequence the air coming from the buffer zone 14A is discharged into the atmosphere through the washing zone 32 and the ventilation ducts 34 provided to each spraying zone 12(12'). Indicated at 52 is a water pipe to supply water to the washing zone 32.

The buffer zone 14A in FIG. 4, too, is smaller than the spraying zones 12 and 12' in vertical cross-sectional area.

When it is desired that air is blown into the spraying zone 12 and the buffer zone 14A substantially at the same temperature and with the same humidity as in the case of using a paint of a heat polymerization type, the ventilation duct 42 may be constructed as a branch of the ventilation duct 22 for the spraying zones 12, 12' with the provision of a regulatable damper (not shown) at the junction. When it is intended to establish a different atmosphere in the buffer zone 14A as in the case of using a water paint, the ventilation ducts 22 and 42 are made independent from each other (to extend from two separate air conditioners, respectively). If in this case a higher temperature is intended in the buffer zone 14A than in the spraying zone 12(12'), an air outlet 48, which communicates with the washing zone 32, may be provided in the side wall of the buffer zone 14A at a location close to the entrance (or exit) of this zone 14A. Besides, air curtain 50 may be provided on the border between the buffer zone 14A and the spraying zone 12(12').

The buffer zone 14A' on the downstream side of this booth 40, too, is smaller than the adjoining spraying zone 12' in vertical cross-sectional area. If desired the ventilation duct 42 may be made to open also into this buffer zone 14A'.

Figure 5:
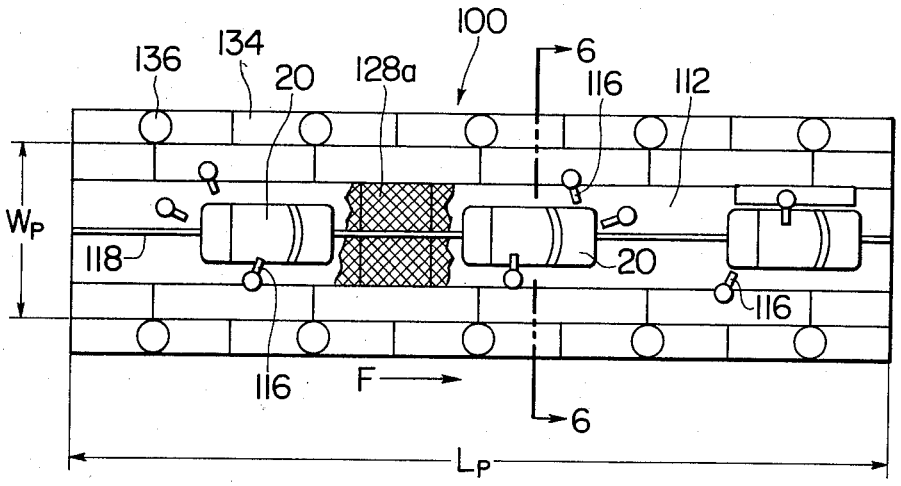
FIG. 5 PRIOR ART
FIG. 5 is a horizontal sectional view of a conventional painting booth on an automobile assembly line.
Figure 6:
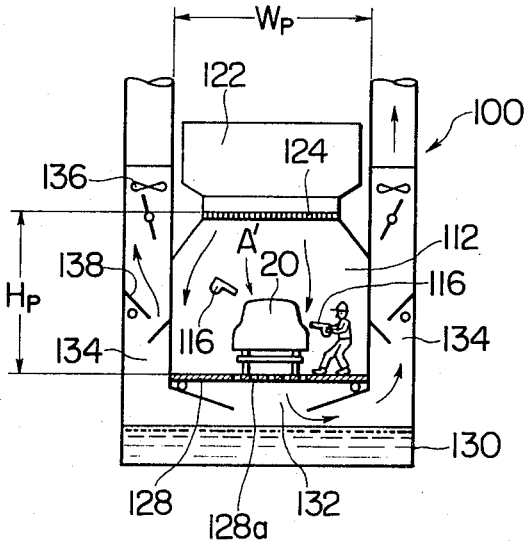
FIG. 6 PRIOR ART
FIG. 6 is a vertical sectional view of the booth of FIG. 5.

For the sake of comparison, FIGS. 5 and 6 show an example of conventional painting booths used in the production of automobiles. This painting booth 100 is a tunnel-like enclosure through which passes a conveyor 118 to carry automobile bodies 20. An elongate spraying room 112 occupies substantially the entire space in this booth 100. A ventilation duct 122 which extends from an external air conditioner including a blower (not shown) is arranged to constitute the ceiling of the spraying room 112 and blow air downwards into the spraying room 112 through an air filter 124. This booth 100 is constructed above a water pit 130, and a floor 128 of the booth 100 takes the form of a grating **128*a* in a transversely central region of the spraying room 112. Accordingly the air (indicated by the arrow A') blown into the spraying room 112 leaves this room 112 through the grating 128*a* to enter a washing zone 132 corresponding to the washing zones 32 in FIGS. 2 and 4. On the outside of the spraying room 112, ventilation ducts 134, which are provided with ventilation fans 136 and paint dust collection means 138, extend from the washing zone 132** to let out the washed air into the atmosphere.

The inside dimensions of the spraying room 112, length $L_P$, width $W_P$ and height $H_P$, are determined such that about 5 to 10 workers can move in this room 112 along automobile bodies 20 on the conveyor 118 to perform spraying operation each with a hand spray gun 116 at any section of the spraying room 112. Accordingly the width $W_P$ and height $H_P$ are uniform over the entire length of the spraying room 112, and the air (A) flows from the ceiling (122) to the floor 128 at a nearly constant velocity in any section of the spraying room 112.

As will be understood from the foregoing description, a painting booth according to the invention is quite suitable for automated painting operations on a mass production line typified by an automobile assembly line. The size of each spraying zone 12(12') is left to designers' discretion with only one restriction that the adjoining buffer zones should be smaller in vertical cross-sectional area than the spraying zone, and any type of automated spraying machines or robots may be installed in the spraying zones. Because of relatively small cross-sectional areas of the buffer zones, a painting booth of the invention affords a great saving of energy as will be demonstrated hereinafter. Besides, the alternate arrangement of the spraying zones and buffer zones (with the above described dimensional relation) in a painting booth of the invention is favorable to the accomplishment of an efficient and successful double-coating operation within the painting booth. As an additional advantage of a painting booth of the invention, it is possible to establish in each buffer zone an atmosphere which is different from atmospheres in the adjoining spraying zones and is most suitable for drying or setting of a paint coating made in a preceding spraying zone, whereby a continuous double-coating operation using a water paint or an organic solvent type paint becomes fully practicable.

The following Table presents a comparison between the painting booth 40 of FIG. 4 and the booth 100 of FIGS. 5–6 with respect to electrical power and the quantity of heat required for the supply of air and water to the respective booths when the booth 40 of FIG. 4 is made comparable to the conventional booth 100 both in total length and vertical cross-sectional area of each spraying zone and the ventilation duct 42 of the booth 40 opens into both of the two buffer zones 14A and 14A'. The calculation was made on the assumption that air is taken from the atmosphere into air conditioners for the respective booths at a temperature of 5° C. and with a relative humidity of 60% and supplied to the booths at 20° C. and with 85% relative humidity. Electric power in the Table refers to the total of the electric powers of air blowers, ventilation fans and a pump (for the delivery of washing water) for each booth. Heat consumption in the Table refers to the consumption of heat in the preparation of steam and hot water for the operation of the air conditioner(s) for each booth.

The comparison given in this Table demonostrates that a painting booth according to the invention affords a great saving of energy: the booth 40 of the invention requires only less than half the electric power required by the conventional booth 100 of substantially the same scale and can be operated with the consumption of only less than half the amount of heat needed for the operation of the booth 100.

Table

| | Painting Booth(40) (of the invention) | | | | Painting Booth(100) (conventional) |
|---|---|---|---|---|---|
| | Spraying Zone No. 1 (12) | Spraying Zone No. 2 (12') | Buffer Zone No. 1 (14A) | Buffer Zone No. 2 (14A') | Spraying Room (112) |
| Inside Dimensions width(m) × height(m) × length(m) | 5 × 6 × 3 | 5 × 6 × 3 | 3 × 2.2 × 6 | 3 × 2.2 × 4 | 5 × 6 × 16 |
| Velocity of Air Flow (average) downwards (m/sec) | 0.5 | 0.5 | — | — | 0.5 |

Table-continued

| | Painting Booth(40) (of the invention) | | | | Painting Booth(100) (conventional) |
|---|---|---|---|---|---|
| | Spraying Zone No. 1 (12) | Spraying Zone No. 2 (12') | Buffer Zone No. 1 (14A) | Buffer Zone No. 2 (14A') | Spraying Room (112) |
| sideways (m/sec) | — | — | 0.2 | 0.2 | — |
| Electric Power (KW) | | 69 | | | 157 |
| Heat Consumption (kcal/hr) | | about 781,000 | | | about 1,772,000 |

What is claimed is:

1. A painting booth through which a conveyor passes substantially horizontally to transfer articles to be painted, the booth comprising:

two spraying spaces located with a distance therebetween in the direction of the conveyor, each having a paint spraying machine disposed therein;

a buffer space which is interposed between said two spraying spaces so as to occupy an entire length of said distance and adjoin both of said two spraying spaces and is smaller in cross-sectional area than either of said two spraying spaces, at least one first duct for blowing air into each of said two spraying spaces through air inlets, each said spraying space having an at least partly grated floor, said air inlets provided for said at least one first duct being located on the ceiling of the spraying space such that a flow of air is established in a direction generally vertically downwards substantially in every region of each of said two spraying spaces, and a second duct for blowing air into said buffer space through two sets of air inlets, said sets of air inlets being located in said buffer space, having one set of inlets directed toward one adjacent spraying space and the other set of inlets directed toward the other adjacent spraying space such that air flows in said buffer space generally horizontally and towards said two spraying spaces at velocities lower than the velocity of said flow of air in each of said two spraying spaces.

2. A painting booth as claimed in claim 1, wherein said at least one first duct is connected to said second duct, whereby air is blown from said at least one first duct and said second duct substantially under the same condition.

3. A painting booth as claimed in claim 1, wherein said second duct is independent from said at least one first duct, whereby air can be blown from said at least one first duct and said second duct under different conditions.

4. A painting booth as claimed in claim 1, wherein said air inlets provided for said second duct are located on a side wall of said selected buffer space.

5. A painting booth as claimed in claim 1 or 2, wherein the buffer space between said two spraying spaces has at least one air outlet provided in a side wall thereof at a location close to one of said two spraying spaces.

6. A painting booth as claimed in claim 1 or 2, further comprising means for providing an air curtain on the border of one of said two spraying spaces and the buffer space between said two spraying spaces.

7. A painting booth as claimed in claim 1, wherein the booth is constructed above a water pit, whereby air blown into each spraying space passes through said grated floor and enters said water pit together with a paint dust.

8. A painting booth as claimed in claim 7, further comprising a ventilation duct connected to said water pit on the outside of the booth so as to discharge air entered into said water pit into the atmosphere.

* * * * *